US006131700A

United States Patent [19]

Farner

[11] Patent Number: 6,131,700

[45] Date of Patent: Oct. 17, 2000

[54] SCAFFOLD PLATFORM

[76] Inventor: Thomas Farner, 258 Juniper Ave., No. 7, Carlsbad, Calif. 92008

[21] Appl. No.: 09/285,495

[22] Filed: Apr. 2, 1999

Related U.S. Application Data

[63] Continuation-in-part of application No. 09/022,833, Feb. 12, 1998, abandoned.

[51] Int. Cl.[7] ..... E04G 1/16; E04G 5/08

[52] U.S. Cl. ..... 182/222

[58] Field of Search ..... 182/222, 119, 182/223, 215, 130, 46

[56] References Cited

U.S. PATENT DOCUMENTS

| | | | |
|---|---|---|---|
| 3,374,861 | 3/1968 | Shaver . | |
| 3,772,419 | 11/1973 | Schoening | 264/112 |
| 3,790,116 | 2/1974 | Schulman . | |
| 4,029,172 | 6/1977 | Green | 182/48 |
| 4,349,297 | 9/1982 | Misener . | |
| 4,496,029 | 1/1985 | Kuroda . | |
| 4,583,618 | 4/1986 | Zimmerman . | |
| 4,742,890 | 5/1988 | de Blauw . | |
| 4,825,976 | 5/1989 | Wyse . | |
| 5,143,173 | 9/1992 | Lubinski . | |
| 5,642,789 | 7/1997 | Maxwell . | |
| 5,762,441 | 6/1998 | Karlsen et al. . | |

*Primary Examiner*—Daniel P. Stodola
*Assistant Examiner*—Hugh B. Thompson
*Attorney, Agent, or Firm*—Brown, Martin, Haller & McClain, LLP

[57] ABSTRACT

A permeable core mat having a plurality of flow channels is saturated in a resin mixture by directing the resin mixture through the plurality of flow channels. A fiberglass sheet is secured to the permeable core mat with the resin mixture. The resin mixture is allowed to cure to resulting in a fiber reinforced composite board having a support structure formed within the plurality of flow channels.

19 Claims, 5 Drawing Sheets

SCAFFOLD PLATFORM

CROSS-REFERENCES TO RELATED APPLICATIONS

This application is a continuation-in-part application of U.S. application Ser. No. 09/022,833 filed Feb. 12, 1998.

BACKGROUND OF THE INVENTION

The present invention relates generally to fiber reinforced composite materials and more specifically to an apparatus and method for providing a scaffold platform having a fiber reinforced composite board.

Scaffold platforms provide an elevated surface for supporting laborers and materials and are commonly used in construction and repair projects by plasterers, painters, electricians, drywall installers, lathers and other workers. Typically, the scaffold platform is mounted to a scaffolding framework at the required elevation. Some scaffold platforms may be suspended at the proper height by attaching the scaffold platform between two ladders or other available structures at the work site.

Conventional scaffold platforms include a wooden plank or plywood sheet attached to an aluminum frame. Although typical scaffold platforms provide adequate strength and support, conventional designs are limited in durability and convenience. Conventional designs are heavy and are negatively effected by moisture resulting in a reduced strength and reduced useful life.

The significant weight of the scaffold platform results in convenience and safety issues since the scaffold platform must often be carried to and from the work site from a vehicle. Locations such as construction sites typically contain rugged terrain having many holes, rocks and other debris or obstacles. These conditions pose a danger to persons carrying the heavy and cumbersome conventional scaffold platforms. Further, the large weight to size ratio often requires more than one person to carry and assemble large scaffold platforms.

One attempt at reducing the dangers of carrying large and heavy scaffold platforms includes using several detachable planks for the support surface of the scaffold platform which allows the user to carry the scaffold platform in several trips rather than in one. This design, however, results in inconvenience to the user because of the time and effort required to transport and assemble the multi-piece platform. In addition, the unsecured planks on the scaffold platform may add to the risk of injury.

Since moisture adversely effects wood, many conventional platforms may have a typical life-span of a only a few years. Water entering the wood elements may cause warping, decreased strength and may cause the wood to deteriorate after continued exposure. Humidity, rain and other precipitation frequently exposes scaffold platforms to moisture. In addition, periodic washing of the scaffold platform is necessary for safety and cosmetic reasons.

Therefore, there is need for a method and apparatus for providing a scaffold platform with a reduced weight to size ratio that is strong, durable, and moisture resistant.

SUMMARY OF THE INVENTION

In an embodiment of the invention, a scaffold platform comprises two composite reinforced fiberglass boards attached to a frame. Each of the composite reinforced fiberglass boards includes a permeable core mat bonded between two fiberglass boards. The permeable core mate has a plurality of flow channels that allow a resin-hardener mixture to flow from one side of the mat to the other while the resin-hardener mixture is in a liquid state. The resin-hardener mixture forms a structural support between the two fiber glass sheets when cured. The structural support provides strength to the composite reinforced fiberglass sheets without adding significant weight.

BRIEF DESCRIPTION OF THE DRAWINGS

The present invention will be better understood from the following detailed description of a preferred embodiment of the invention, taken in conjunction with the accompanying drawings in which like reference numerals refer to like parts and in which.

DESCRIPTION OF THE PREFERRED EMBODIMENT

Figure 1:
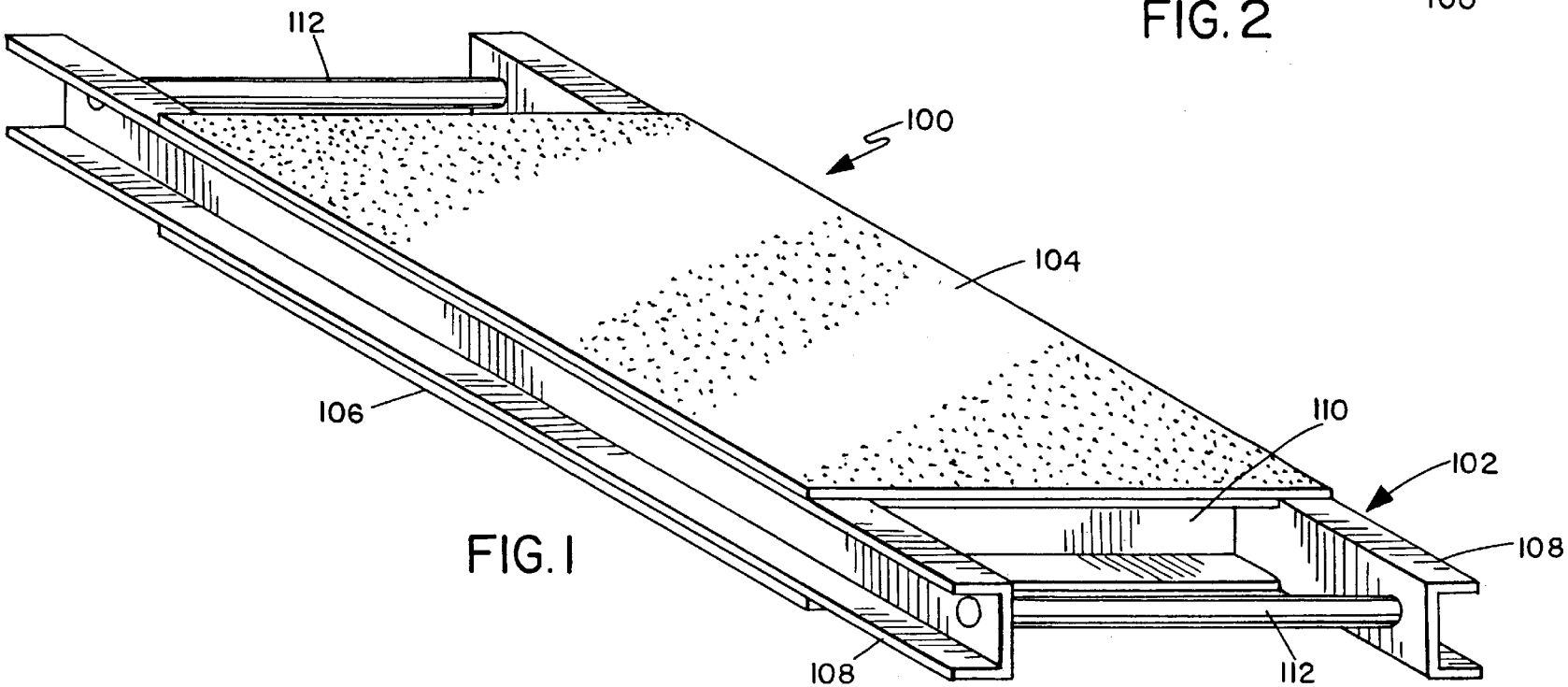
FIG. 1 is an isometric view of a scaffold platform in accordance with a preferred embodiment of the invention.

FIG. 1 is an isometric drawing of a scaffold platform 100 in accordance with the preferred embodiment of the present invention. The scaffold platform 100 includes two fiber reinforced composite boards 104, 106 attached to a frame 102. The top fiber reinforced composite board (top fiber board) 104 is similar to the bottom fiber reinforced composite board (bottom fiber board) 106 except that the top board 104 has a textured surface facing to the outside of the scaffold platform toward the user. The frame 15 has a two longitudinally extending side beams 108 which are positioned parallel to one another and provide support for the scaffold platform 100. Preferably, the side beams 108 are made from a fiber-resin composite using pulltrusion techniques and have a "C"-beam structure. However, the side beams 108 may be, "I"-beams, "W"-beams or any other type of beam structure consistent with known beam designs.

Dimensions of the side beams 108 including the depth, flange width, flange thickness, web thickness and length are chosen in accordance with known techniques, the particular intended purpose and size of the scaffold platform 100, and the anticipated flexibility and strength of the two fiber reinforced composite boards (104,106). Alternate materials such as aluminum, wood, or fiberglass may also be used to construct the side beams 108 to form a frame 102 sufficient to support the scaffold platform 100 during its intended use.

In alternate embodiments, color pigment is added during the pultrusion process to color the side beams 108. In addition to cosmetic purposes, the side beams 108 may be colored to identify specific portions of the beams 108 or to highlight the beams 108 for safety reasons.

The frame 102 includes two end caps 110 that are positioned perpendicular to the side beams 108 at each end of the scaffold platform 100. Each end cap 110 is, preferably, positioned approximately six inches from outside ends of the side beams 108. The position of the end caps 110 may vary depending on the size of the scaffold platform 100. In the preferred embodiment, the end caps 110 are made of the same material and are of the same cross section size as the side beams 108 The end caps 110 provide additional structural support in addition to preventing contaminants from entering the inside of the scaffold platform 100.

The end caps 110 are attached to the side beams 108 by an adhesive such as a mixture of epoxy and hardener. Preferably, the epoxy is a base component of a versatile epoxy system that bonds fiberglass and other materials and provides a high strength moisture resistive coating. The epoxy can be any one of a variety of epoxies used for composite material construction and repairs.

As is known, the epoxy base is mixed with a hardener to produce the epoxy mixture which cures into a solid material. Although fast cure hardeners may be used, the epoxy base is preferably mixed with a slow cure hardener since slow cure hardeners result in a cured bond that is more pliable than bonds formed with a fast cure hardener. After applying the epoxy-hardener mix, it is allowed to harden and dry for 8 to 12 hours to form the bonds between the different members of the frame 102. Although an epoxy is preferred, glue, resin, or any other type of adhesive sufficient to secure the end caps 110 in place may be used. Alternately, screws, bolts or types of fasteners may be used to attach the end caps 110 to the side beams 108.

In the preferred embodiment, a handle 112 is attached at each end of the frame 102 to allow the scaffold platform 100 to be easily moved. The handles 102 extend perpendicularly in between the side beams 108 and are generally round dowels of uniform thickness and diameter and are made by pultrusion techniques. Other methods which make the handles 112 sufficiently strong to sustain the weight of the platform, however, may be used. The handles 112 are attached to the side beams 108 by inserting the ends of the handles into precut holes within the side beams approximately three inches from the outside ends of the side beams. The position and size of the handles 112 depend on the size of the scaffold platform 100 and its intended use. The handles 112 are preferably attached using the epoxy but may be secured with resin, glue, pins, or any other adhesive or mechanism that is sufficient to secure the handles in place. The handles 112 are preferably coated with a non-slip agent such as a rubber or urethane based texturing spray.

Figure 2:
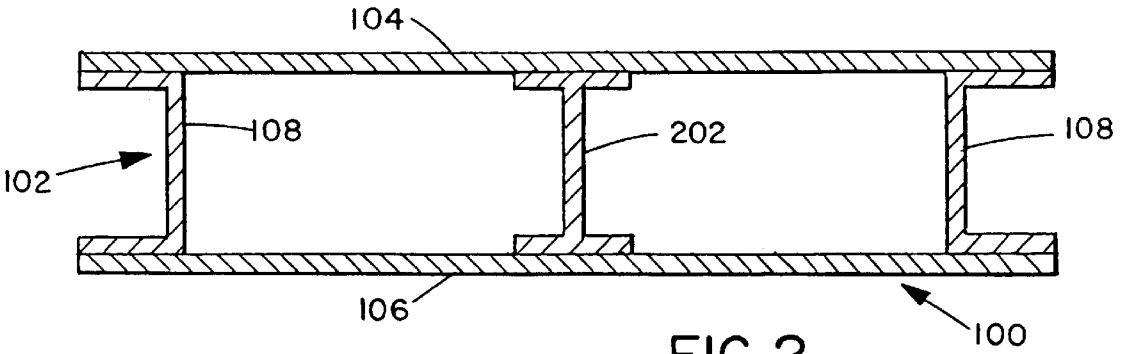
FIG. 2 is a cross-sectional view of the scaffold platform in accordance with the preferred embodiment of the invention.

A cross-sectional view of the frame 102 in accordance with the preferred embodiment of the invention is shown in FIG. 2. In the preferred embodiment, the frame includes a center beam 202 that is attached between the two end caps 110 equidistantly between and parallel to the side beams 108. The center beam 202 is, preferably, an "I"-beam but may be any one of several types of known beam structures such as "C"-beams or "W"-beams. In the preferred embodiment, the center beam 202 is attached to the end caps 110 with the epoxy. The center beam 202, however, may be attached to the end caps 110 with adhesives, glues, resins or fasteners such as screws or bolts.

Referring again to FIG. 1, the top fiber board 104 and the bottom fiber board 106 are attached to the top and bottom of the scaffold frame 102, respectively. When the scaffold 100 is in use, the top fiber board 104 provides a surface for the user of the scaffold on which to walk or on which to place materials. The top fiber board 104 and the bottom fiber board 106 are cut to fit the size of the frame 102 and are attached to the side beams 108, center beam and the end caps 110. In the preferred embodiment, the top and bottom boards 104, 106 are bonded to the frame 102 using the epoxy used for joining the members of the frame. The top and bottom boards 104, 106, however, may be attached to the frame 102 using a variety of techniques including bonding with glues or resins or by attaching the boards 104, 106 using fasteners such as screws or bolts.

Figure 3:
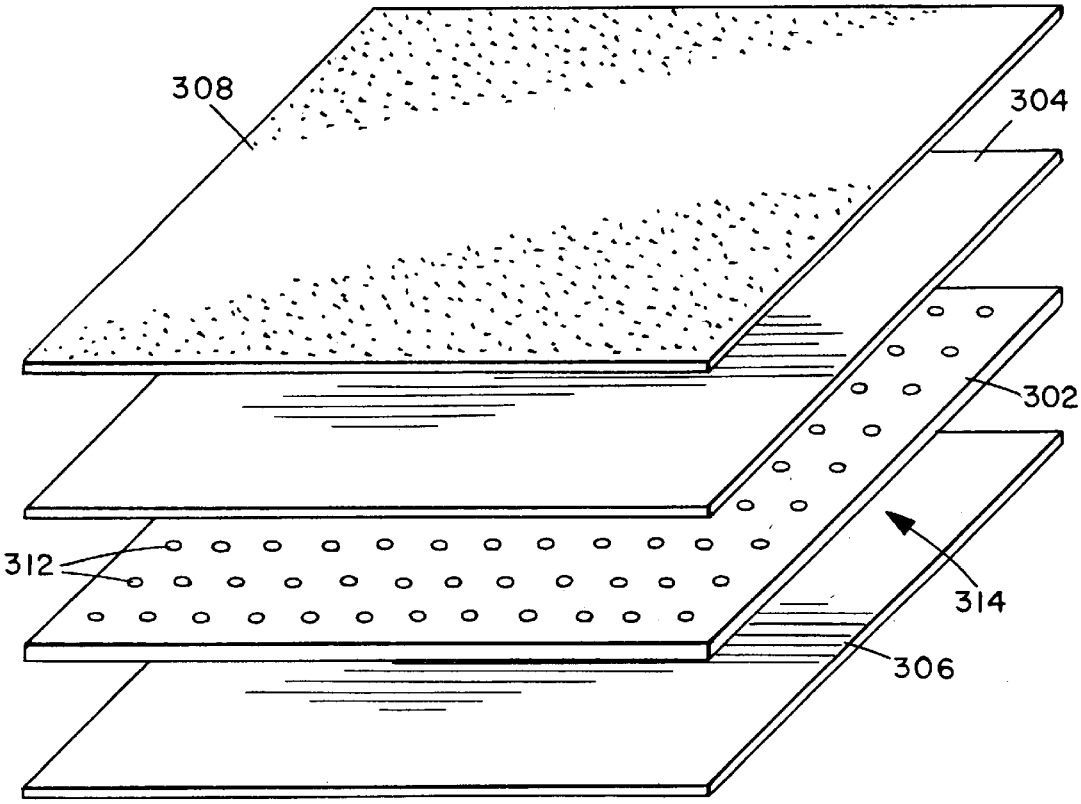
FIG. 3 is an exploded isometric view of the top composite reinforced board in accordance with the preferred embodiment of the invention.

FIG. 3 is an exploded isometric drawing of the top fiber reinforced composite board 104 in accordance with the preferred embodiment of the present invention. A permeable core mat 302 is bonded between a first fiberglass sheet 304 and a second fiberglass sheet 306. A peel-ply sheet 308 is bonded to the first fiberglass sheet 304 and provides a slip resistant surface on the outside surface of the top board 104. The peel-ply sheet 308 has a textured surface that provides friction between the user and the scaffold which allows the user to move safely on the scaffold. The textured surface also helps to prevent materials from sliding off of the scaffold platform 100.

The permeable core mat 302 is, preferably, a spun cotton or polyester fiber cloth having a plurality of flow channels 312 extending from the first side to the second side of mat 302. The channels 312 are preferably of cylindrical shape. As described below in more detail, each of the flow channels 312 provides a channel through which epoxy, when in a liquid state, can freely flow through the permeable core mat. In the preferred embodiment, the plurality of flow channels 312 are equidistantly and uniformly spaced within the permeable core mat to form a flow channel pattern 314. The plurality of flow channels 312, however, may be arranged in a variety of patterns including non-equidistant or non-uniform patterns. For example, the plurality of flow channels 312 may be arranged in a circular or spiral pattern.

Preferably, each of the flow channels 312 has a uniform cylindrical shape extending form one side of the permeable core mat 302 to the other. Alternate shapes may include any type of symmetrical or non-symmetrical opening extending between the two sides of the permeable core mat 302.

In the preferred embodiment, the density (the number of flow channels 312 per area) depends on the required strength and weight of the fiber reinforced composite board 104, 106. As the flow channel density is increased, the strength and weight increases and flexibility decreases of the resulting fiber reinforced composite board 104, 106. Preferably, the permeable core mat 302 has a density of approximately twelve flow channels per square inch. In alternate embodiments, the density of the flow channel pattern 314 is not uniform but is varied in accordance with the desired strength and weight of a particular section of the fiber reinforced composite board 104, 106. The number of flow channels 312 is increased in areas of the fiber board 104, 106 requiring more strength.

Figure 4:
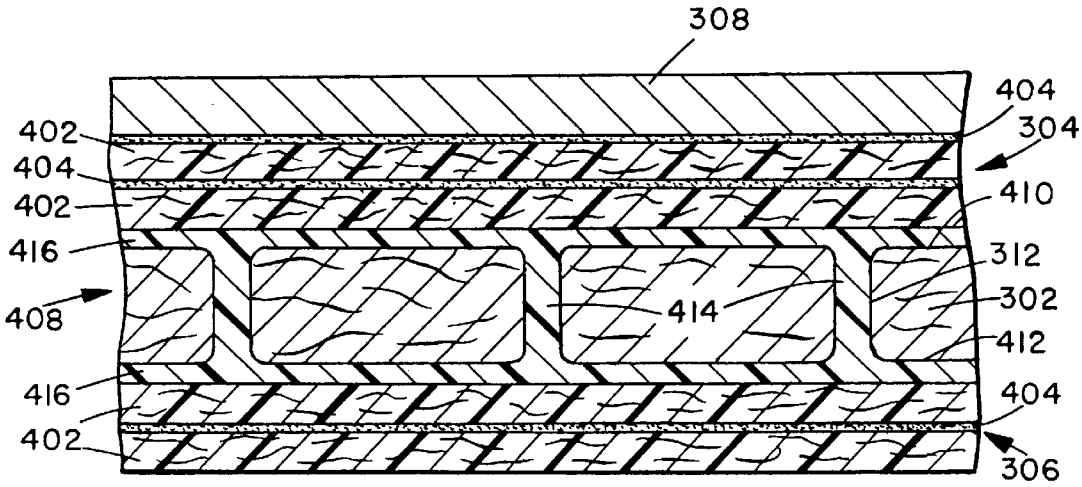
FIG. 4 is a cross-sectional view of the top composite reinforced board in accordance with the preferred embodiment of the invention.

FIG. 4 is a cross-sectional view of the top board 104 in accordance with the preferred embodiment of the invention. In the preferred embodiment, the resin used to bond the fiberglass cloths 402 and permeable core mat 302 is any one of several commercially available high strength fiberglass resins. The resin mixture is mixed with a slow cure hardener to produce a resin mixture that remains in a liquid state for several hours. The resin mixture cures into the somewhat flexible, moisture resistant resin after it is allowed to dry for approximately 8 to 12 hours. As is known, the drying time depends on humidity, temperature, the type of resin and the type and amount of resin hardener.

In the preferred embodiment, the first and second fiberglass sheets 304, 306 are each formed from two resin saturated six ounce fiberglass cloths 402. A thin layer of resin 404 separates the two cloths 402 from each other and another thin layer of resin 404 separates the first fiberglass sheet 304 from the peel-ply sheet 308. Similarly, a layer of resin 404 bonds the two resin saturated 6 ounce fiberglass cloths 402.

After the permeable core mat 302 is saturated with the resin mixture and bonded to the first fiberglass sheets 304, 306, the resin mixture cures to form a support structure or truss 408. As will be described below in regard to FIG. 5, the flow channels allow the resin mixture to flow from a first side 410 to a second side 412 of the permeable core mat 302 when the mat is saturated with the resin mixture. When the resin cures within the plurality of flow channels, a truss or support structure 408 is formed having a small pillar 414 within each of the flow channels 312. The truss or support structure 408 also includes thin layers of cured resin 416 between the fiberglass sheets 304, 306. Therefore, after the resin cures a high strength, light-weight fiber reinforced composite board 104 is formed having an internal support structure 408.

Figure 5:
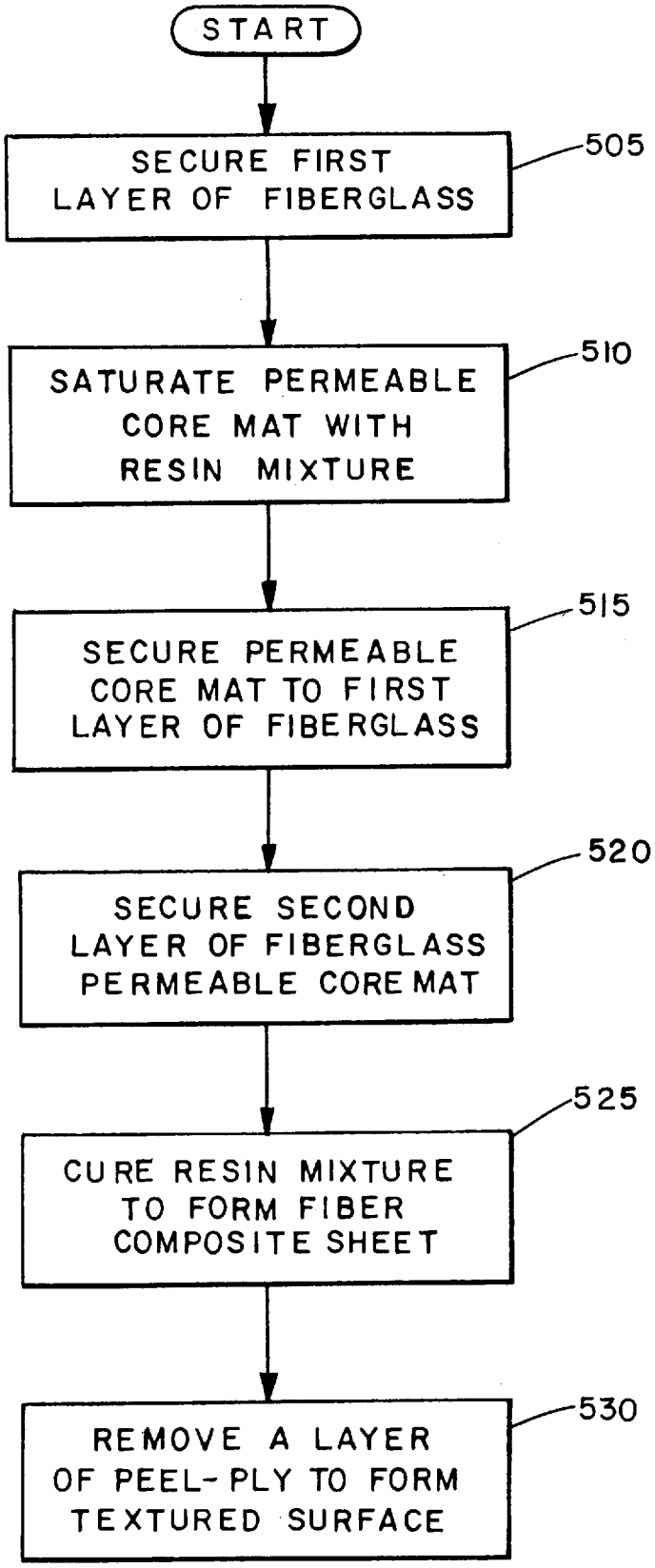
FIG. 5 is a flow chart of method of manufacturing a composite reinforced fiber board in accordance with the preferred embodiment of the invention.

FIG. 5 is a flow chart of method of manufacturing a top fiber reinforced composite board 104 in accordance with the preferred embodiment of the invention. At step 505, a first layer of fiberglass 304 is secured to the layer of peel-ply. A first six ounce fiberglass cloth 402 is saturated in a mixture of resin and slow cure hardener and placed on the peel-ply sheet 308. While the resin on the first fiberglass cloth 402 is still uncured, a second 6 ounce fiberglass cloth is saturated in the resin mixture and placed on the first cloth 402. In the preferred embodiment, the fiberglass cloths 402 are uniformly coated with the resin mixture and air bubbles are removed form the layer of fiberglass 304. Although, in preferred embodiment, the first layer of fiberglass 304 comprises two six ounce fiberglass cloths 402, the first layer 304 may include any number of fiberglass cloths 402 and each of the fiberglass cloths 402 may be of any weight consistent with known resin layering techniques.

At step 510, the permeable core mat 302 is saturated with the resin mixture. The resin mixture is directed into the plurality of flow channels 312 by repeatedly brushing the resin mixture across the surfaces 410 of the permeable core mat 302. The resin mixture flows through the flow channels from one side 410 to the other 412 until the flow channels 312 are filled with the resin mixture. Preferably, the resin mixture is uniformly distributed over both sides 410, 412 of the permeable core mat 302. Due to the structure of the permeable core mat 302, however, the solid areas within the permeable core mat 302 that do contain a flow channel 312 do not significantly absorb the resin mixture. In this way, the a strong support structure 408 can be formed without using extensive amounts of resin which results in fiber reinforced composite board having a significantly lower weight than if the permeable core mat 302 was allowed to become fully saturated within the areas that do not have flow channels 312.

At step 515, the saturated permeable core mat 302 is placed on the first layer of fiberglass 304. A thin layer of the resin mixture is formed between the first layer of fiberglass 304 and the permeable core mat 302 that will become a thin layer of cured resin 416.

At step 520, a second layer of fiberglass 306 in secured to the permeable core mat 302. A first six ounce fiberglass cloth 402 is saturated in the resin mixture and placed on the permeable core mat 302 before the resin mixture within the flow channels 312 and on the surfaces 410 of the permeable core mat 302 has cured. A second fiber glass cloth 402 is saturated and placed on the first fiberglass cloth 402 before the resin mixture saturating the first fiberglass cloth 402 has cured.

At step 525, the resin mixture used to saturate and join the fiberglass sheets 304, 306 and permeable core mat 302 is cured to form the fiber reinforced composite board 104 by allowing the resin mixture to dry for at least eight hours.

A layer of peel-ply is removed from the composite fiber sheet at step 530 to provide a textured surface on the outside surface of the fiber reinforced composite board.

Therefore, a fiber reinforced composite board 104, 106 is formed by bonding resin saturated fiberglass cloths 402 to a resin saturated permeable core mat 302 having a plurality of flow channels 312. After the resin has cured the truss support structure 408 is formed within and around the permeable core mat 302 and between the fiber. The resulting fiber reinforced composite board 104 is attached to a frame 102 to form a scaffold platform having a higher strength to weight ratio than prior art scaffolds. The high strength, light weight scaffold platform can be easily transported and assembled on a scaffolding framework or ladder structure.

Figure 6:
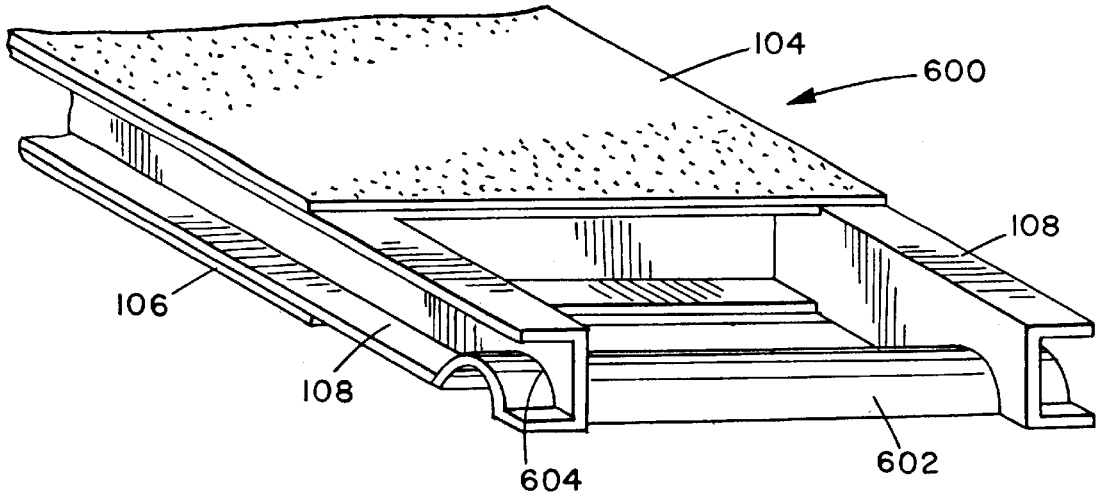
FIG. 6 is an isometric view of a scaffold platform in accordance with the first alternate embodiment of the present invention.

FIG. 6 is an isometric view of a scaffold platform 600 in accordance with the first alternate embodiment of the present invention. The scaffold platform 600 in the first alternate embodiment is similar to the scaffold platform 100 in the preferred embodiment except that the scaffold platform 600 in the first alternate embodiment includes mounting hooks 602 instead of the handles 112. The mounting hook 602 is used to secure the scaffold platform 600 to a scaffolding framework, rung of ladder or other secure fixture. The mounting hooks 602 are made from round hollow poles of uniform thickness and diameter which are cut in half along their length. Preferably, the mounting hooks 602 are manufactured by pultrusion techniques. Any other method, however, may be used that results in mounting hooks 602 sufficiently strong to sustain the weight of the platform during use. Matching half circles 604 pre-cut into the side beams 108 at approximately three inches from the side beam 108 ends to receive the mounting hooks 602. The position along the side beam 108 and the size of the mounting hooks 602 depend on the size and intended purpose of the scaffold platform 600 as will be apparent to those skilled in the art. The mounting hooks 602 are attached in their matching half circles by an epoxy similar to that used to join the elements of the frame 102. Resin, glue, pins, or any other adhesive or mechanism that is sufficient to secure the mounting hooks 602 in place, however, may be used. The mounting hooks 602 are preferably coated with a non-slip agent such as a rubber or urethane based texturing spray.

Figure 7:
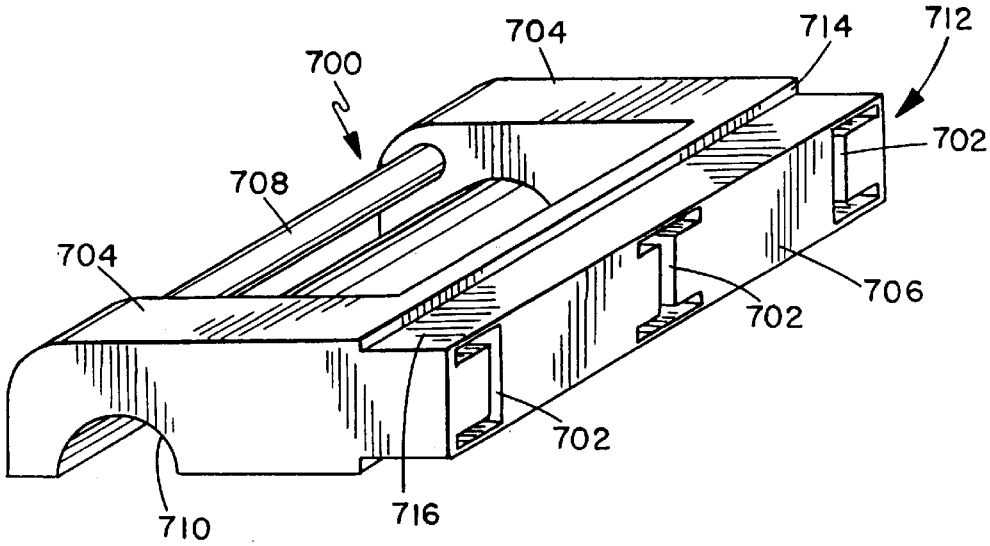
FIG. 7 is an isometric view of an end cap in accordance with a second alternate embodiment of the present invention.

FIG. 7 is an isometric view of an end cap 700 in accordance with a second alternate embodiment of the present invention. The end cap 700 is part of a frame of the scaffold platform (not shown) discussed below in regard to FIG. 8. The end cap 700 is constructed using injection molding techniques and includes two end cap side beams 704, an end cap cross beam 706 and a handle 708 connected transversely between the two end cap side beams 704. The end cap has a mounting hook 710 similar to the mounting hook 602 discussed in regard to the first alternate embodiment. The end cap cross beam includes slots 702 in an attaching end 712 of the end cap 700 for receiving the side and center beams of the scaffold platform discussed in detail below in regard to FIG. 8. The slots are shaped in accordance with the type of beam that will be mounted within the slot 702. The attaching end 712 of the end cap 700 is adapted to fit the end of the scaffold platform by allowing the side and center beams to enter through the slots 702 and allowing the top and bottom boards 104, 106 to fit over the end cap cross beam 706. A lowered ledge 716 is formed along the portion of the end cap 700 where the top and bottom boards 104, 106 attach to the end cap 700. A step 714 is formed where the lowered ledge meets the remainder of the end cap 700. The step 714 on the top of the end cap 700 has a height equal to the thickness of the top board 104 and the step on the bottom of the end cap 700 has a height equal to the bottom board 106. In this way, flush joints are formed between the end cap 700 and the remainder of the scaffold platform described below.

Figure 8:
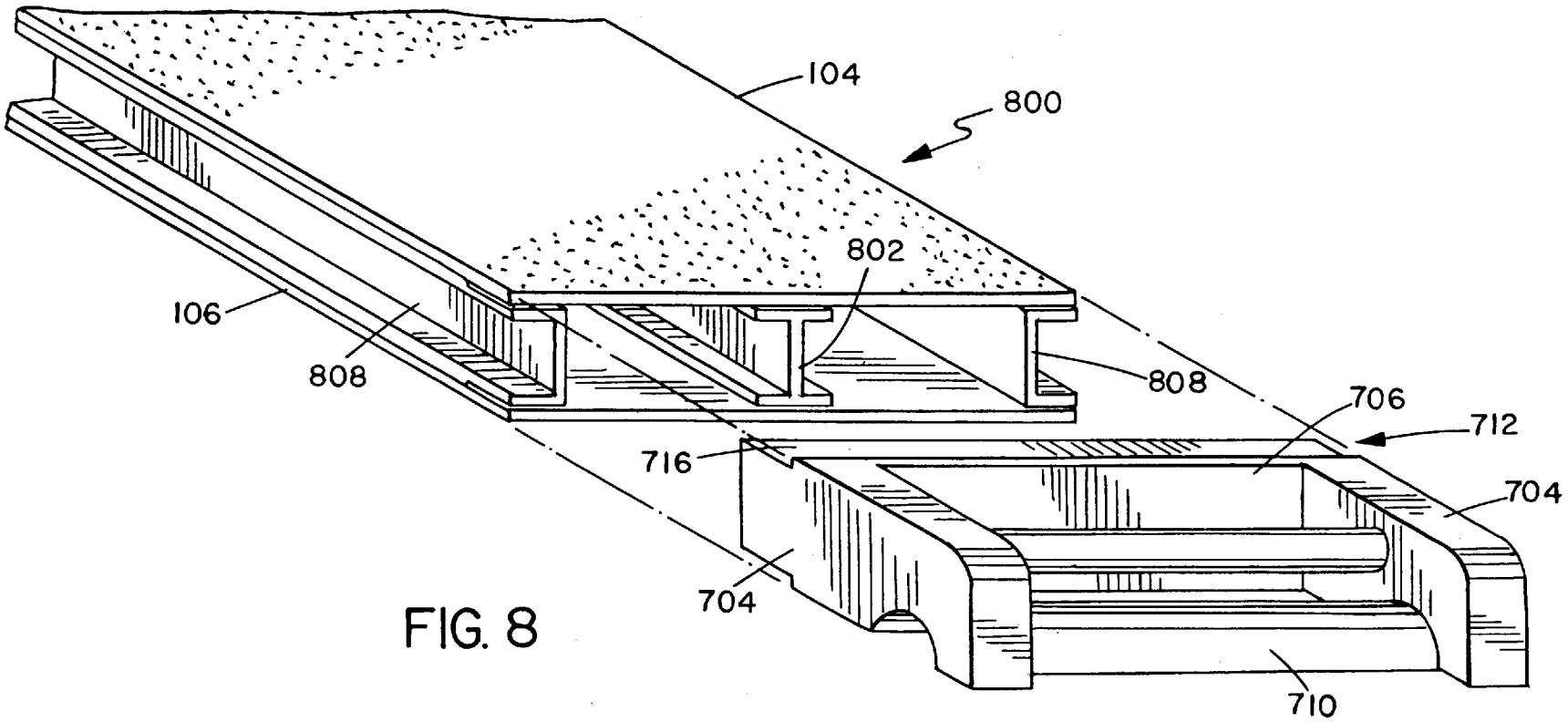
FIG. 8 is an isometric exploded view of a scaffold platform in accordance with the second alternate embodiment of the present invention.

FIG. 8 is an isometric exploded view of a scaffold platform 800 in accordance with the second alternate embodiment of the invention. The scaffold platform 800 in the second alternate embodiment is similar to the scaffold platform 100 in the preferred embodiment except that side beams 808 and center beam 802 are flush with the top and bottom boards 106, 107 and the end cap 700 is as described above in regard to FIG. 7. A frame 810 is formed by the two side beams 808, the center beam 802 and two end caps 700 by inserting the side beams and the center beam 802 into their respective slot 702 in the end cap cross beam 706 and by joining the components with the epoxy.

The top board 104 is attached with the epoxy to the frame 810 such that the top board 104 interfaces with the lowered ledge 716 and the step 714 to form a flush joint. The bottom board 106 is attached similarly to the lowered ledge 716 on the bottom side of the end cap 700.

Other embodiments and modifications of the present invention will occur readily to those of ordinary skill in the art in view of these teachings. Such persons will appreciate the symmetries among the various embodiments illustrated above and understand that their elements may be arranged in other ways to produce similar results. For example, a single top board can be mounted to the frame without the use of a second bottom board without departing from the scope of the invention. Also, the handles 112 and the mounting hooks 602 may be interchanged to produce a scaffold platform having a handle 112 at one end and a mounting hook at the other end of the scaffold platform Therefore, this invention is to be limited only by the following claims, which include all such other embodiments and modifications when viewed in conjunction with the above specification and accompanying drawings.

I claim:

1. A fiber reinforced composite board, comprising:

a permeable core mat having a plurality of flow channels extending from a first side of the permeable core mat to a second side of the permeable core mat;

a resin mixture filling each of said flow channels and extending from the first side to the second side of the mat through said flow channels, and the resin mixture also extending over the first and second sides of the mat to form a thin cover layer of resin mixture on each side of the mat;

a first fiberglass sheet secured to the cover layer of resin mixture on the first side of the permeable core mat; and a second fiberglass sheet secured to the cover layer of resin material on the second side of the permeable core mat, the resin mixture forming structural supports extending between the first fiberglass sheet and the second fiberglass sheet through the flow channels.

2. A fiber reinforced composite board in accordance with claim 1, wherein the plurality of flow channels are cylindrical.

3. A fiber reinforced composite board in accordance with claim 1, wherein the plurality of flow channels are equally spaced.

4. A composite scaffold platform, comprising:

a frame having a pair of spaced, parallel longitudinal beams and at least two cross beams extending between the side beams, the frame having a top side and a bottom side;

a fiber reinforced composite board secured to the top side of the frame and comprising:

a permeable core mat having a plurality of flow channels extending from a first side of the permeable core mat to a second side of the permeable core mat;

a resin mixture filling each of said flow channels and extending from the first side to the second side of the mat through said flow channels, and the resin mixture also extending over the first and second sides of the mat;

a first fiberglass sheet secured to the first side of the permeable core mat by means of the resin mixture extending over the first side of the mat; and a second fiberglass sheet secured to the second side of the permeable core mat with the resin mixture extending over the second side of the mat, the resin mixture forming a structural support between the first fiberglass sheet and the second fiberglass sheet.

5. A composite scaffold platform in accordance with claim 4, further comprising a handle transversely secured to the longitudinal beams of the frame.

6. A composite scaffold platform in accordance with claim 4, further comprising a mounting hook secured to the longitudinal beams of the frame.

7. A composite scaffold platform in accordance with claim 4, further comprising a second fiber reinforced composite board secured to the bottom side of the frame, the second fiber reinforced composite board comprising:

a second permeable core mat having a plurality of flow channels extending from a first side of the second permeable core mat to a second side of the second permeable core mat;

a resin mixture filling each of said flow channels and extending from the first side to the second side of the second permeable core mat through said flow channels, and the resin mixture also extending over the first and second sides of the mat;

a third fiberglass sheet secured to the first side of the second permeable core mat by means of the resin mixture extending over the first side of the mat; and a fourth fiberglass sheet secured to the second side of the second permeable core mat with the resin mixture extending over the second side of the mat, the resin mixture forming a structural support between the third fiberglass sheet and the fourth fiberglass sheet.

8. A fiber reinforced composite board, comprising:

a fiberglass sheet;

a permeable core mat having opposite first and second sides and a plurality of flow channels extending from said first side to said second side;

a resin mixture filling each of said flow channels and extending from the first side to the second side of the mat through said flow channels, and the resin mixture also extending over the first and second sides of the mat, whereby the resin mixture in the channels forms structural supports when the resin mixture hardens to a solid state; and the first side of the mat being secured to the fiberglass sheet by the resin mixture extending over the first side of the mat.

9. A fiber reinforced composite board in accordance with claim 8, further comprising a planar member secured to the second side of the permeable core mat with the resin mixture extending over the second side of the mat.

10. A fiber reinforced composite board in accordance with claim 9, wherein the planer member is a second fiberglass sheet.

11. A fiber reinforced composite board in accordance with claim 8, wherein the plurality of flow channels are substantially cylindrical and are equally spaced within the permeable core mat.

12. A fiber reinforced composite board in accordance with claim 8, wherein; the surface of the fiberglass sheet is textured with a layer of peel ply.

13. A method for manufacturing a fiber reinforced composite board comprising:

distributing a first portion of a resin mixture on a fiberglass cloth;

securing the first fiberglass cloth to a peel-ply sheet;

distributing a second portion of resin mixture on a permeable core mat having a plurality of flow channels extending from a first side of the permeable core mat to a second side of the permeable core mat;

directing the resin mixture through the plurality of flow channels from the first side of the permeable core mat to the second side of the permeable core mat; and securing a surface opposite of the peel-ply sheet of the fiberglass cloth to the permeable core mat while the resin mixture is in a fluid state, and allowing the resin mixture to cure to form a structural support within the flow channels.

14. The method for manufacturing a fiber composite board in accordance with claim 13, further comprising the step of:

securing a planar material to the permeable core mat on the side opposite of the first fiberglass cloth while the resin is in a fluid state, and allowing the resin mixture to cure and to form a structural support within the flow channels between the fiberglass cloth and the planar material.

15. The method for manufacturing a fiber composite board in accordance with claim 13, comprising the steps of:

distributing a third portion of resin mixture on another fiberglass cloth; and securing the another fiberglass cloth to the permeable core mat to the side opposite of the fiberglass cloth while the second portion of the resin mixture is in a fluid state, and allowing the resin mixture to cure to form a structural support within the flow channels between the first fiberglass cloth and the second fiberglass cloth.

16. The method for manufacturing a composite scaffold platform, comprising the steps:

forming a first fiber reinforced composite board by:

evenly distributing a resin on a fiberglass cloth;

evenly distributing a resin on a permeable core mat having a plurality of flow channels extending from a first side of the permeable core mat to a second side of the permeable core mat;

directing the resin through the plurality of flow channels from a first side of the permeable core mat to a second side of the permeable core mat; and securing the fiberglass cloth to the core mat while the resin is in a fluid state, and allowing the resin to cure and to form a structural support within the flow channel; and attaching the first fiber reinforced board to a frame having a beam.

17. The method for manufacturing a composite scaffold platform in accordance with claim 16, further comprising the steps of:

preparing a second fiber reinforced composite sheet by:

evenly distributing a resin on a second fiberglass cloth;

depositing and evenly distributing a resin on a permeable core mat having a plurality of flow channels extending from a first side of the permeable core mat to a second side of the permeable core mat;

directing the resin through the flow channels from the first side of the permeable core mat to the second side of the permeable core mat; and securing the second fiberglass cloth to the core mat before the resin mixture has cured, and allowing the resin mixture to cure and to form a structural support within the plurality of flow channels; and attaching the second fiber reinforced board to the frame opposite the side of the first fiber reinforced composite board.

18. A method of manufacturing a fiber reinforced composite board, comprising the steps of:

saturating a permeable core mat having a plurality of flow channels extending from a first side to a second side of the mat with a resin mixture in a liquid state so that the liquid resin mixture extends through the flow channels between the first and second sides of the mat and extends over the first and second sides of the mat;

securing the first side of the permeable core mat to a fiberglass sheet with the resin mixture extending over the first side of the mat; and curing the resin mixture to form a support structure within the plurality of flow channels.

19. A method in accordance with claim 18 further comprising the step of securing a second fiberglass sheet to the second side of the permeable core mat.

* * * * *